United States Patent [19]

Pyzel et al.

[11] 3,985,371

[45] Oct. 12, 1976

[54] TOURING SKI BOOT HEEL BINDING

[75] Inventors: Ewald D. Pyzel; Harold E. Codding, both of Reno, Nev.

[73] Assignee: Ski Safe Inc., Carson City, Nev.

[22] Filed: Sept. 22, 1975

[21] Appl. No.: 615,807

Related U.S. Application Data

[62] Division of Ser. No. 536,971, Dec. 23, 1974, Pat. No. 3,953,042.

[52] U.S. Cl. ..... 280/614

[51] Int. Cl.[2] ..... A63C 9/08

[58] Field of Search ..... 280/614, 631, 632

[56] References Cited

UNITED STATES PATENTS

| | | | |
|---|---|---|---|
| 3,408,087 | 10/1968 | Ramillon | 280/631 |
| 3,416,812 | 12/1968 | Grembruch, Jr. | 280/631 |
| 3,753,572 | 8/1973 | Labor | 280/614 |
| 3,773,340 | 11/1973 | Salomon | 280/632 |
| 3,863,941 | 2/1975 | Hausleithner | 280/614 |

FOREIGN PATENTS OR APPLICATIONS

| | | | |
|---|---|---|---|
| 274,631 | 9/1968 | Austria | 280/614 |

*Primary Examiner*—Robert R. Song

*Attorney, Agent, or Firm*—Pennie & Edmonds

[57] ABSTRACT

The heel binding for touring skis comprises a frame adapted to be secured to the upper surface of a touring ski, a rotatable heel latch pivotally mounted on the frame for rotation between its forwardmost boot heel engaging position and its rearwardmost boot heel disengagement position, and latch engagement and disengagement means for maintaining the heel latch in engagement with the heel of the ski boot when the heel latch is at its forwardmost position and for maintaining the heel latch out of engagement with the heel of the ski boot when the heel latch is at its rearwardmost position. The latch engagement and disengagement means has an operating lever pivotally mounted on the frame rearwardly of the heel latch for rotating the heel latch to its forwardmost position, the operating lever acting either directly or indirectly on the heel latch. The latch engagement and disengagement means also has a spring loaded piston mounted for longitudinal movement on the frame rearwardly of the heel latch for rotating the heel latch to its rearwardmost position, the spring loaded piston advantageously being connected to the heel latch by an eccentric overcenter linkage.

7 Claims, 16 Drawing Figures

TOURING SKI BOOT HEEL BINDING

This is a division of application Ser. No. 536,971, filed Dec. 23, 1974, now U.S. Pat. No. 3,953,042.

BACKGROUND OF THE INVENTION

1. Field of the Invention

This invention relates to ski boot bindings, and in particular to a binding for the heel of a touring ski boot.

2. Prior Art

Ski touring, or cross-country skiing, involves travelling on snow using very light weight, narrow skis. Suitable terrain for this type of skiing is less steep than most alpine, or downhill ski courses, and involves climbing, walking on level terrain and, inevitably, skiing down moderate slopes. Skis used for touring are long, narrow and of very light construction usually of either laminated wood or fiberglass. Touring boots are lightweight and low cut and have a very flexible sole to allow the boot heel to be raised freely while walking or gliding on the skis. Conventional touring ski boot bindings (of which there are several well known types) attach only the toe of the boot to the ski to allow this.

Touring or cross-country ski boots and ski bindings are markedly different from alpine or downhill ski boots and ski bindings. As noted, touring ski boots are comfortable and lightweight with soft flexible uppers and flexible soles that are normally attached to the ski at the toe end only. Alpine ski boots are heavy rigid affairs with thick inflexible soles that are attached to the skis at both front and rear ends. Touring ski bindings normally secure the toe only of the ski boot to the ski, and these toe bindings do not have a safety release feature and must be released by hand. Alpine ski bindings have built-in safety release features which automatically release the ski boot in the event of an accident while skiing.

Touring ski boot toe bindings serve their intended purpose very well in that they permit the skier to move on his skis with a natural walking motion uphill, on the level and down small slopes. However, these touring ski bindings do not provide adequate control of the skis when sliding down hill on steeper slopes. That is to say, due to the softness of the touring boot and the flexibility of the sole, the heel of the boot has very little lateral stability when the skier is standing on the ski and sliding downhill. In order to provide the desired control for downhill skiing the ski boot should somehow be immobilized and/or attached to the ski at the heel.

One known procedure for improving the lateral stability of the heel of the boot on the ski involves attaching a plate with raised, serrated edges to the ski under the heel of the boot to hold the latter in place when the heel is weighted. However, serrated heel plates do not provide a positive anchoring of the boot heel, and excessive lateral heel movement makes turning the touring ski difficult. Another known procedure involves the use of a cable that extends around the heel of the boot to either the toe binding or to a lever positioned on the ski in front of the toe binding. The cable bindings used on touring skis are designed primarily to maintain the boot in the toe binding while allowing the heel to be raised freely. Placement of cable guiding lugs along the sides of the ski between the toe and the heel will permit a degree of positive hold-down of the boot heel, but due to the soft sole construction of the touring boot, a compression and buckling of the boot sole may result, thus limiting the allowable hold-down force. In practice cable bindings used in this manner do not provide the desired heel stability for turning touring skis. In the event of a forwards fall, cable bindings are incapable of safety-release, which usually results in a broken ski.

Boot heel retaining forces for downhill skiing on touring skis are must less than that required for alpine equipment. Nonetheless, some degree of vertical hold down and high lateral stability of the boot heel should be provided when skiing downhill. The vertical hold down of the boot heel may be of the positive type (that is, non-releasable except intentionally by the skier), or it may be of the safety release type that releases automatically when heel stresses on the binding exceed a predetermined value (as when a ski tip goes under the snow or the skier accidently falls). Of course, when walking or gliding on the skis a touring ski heel binding should allow unobstructed vertical motion of the heel. Accordingly, after an intensive investigation of these and related problems invloved in providing satisfactory control of touring skis on downhill slopes, we have developed a novel binding for the heels of touring ski boots that is light in weight, reliable in operation, and readily engaged or disengaged by the skier without in any way affecting the function or security of the separate toe binding of the touring ski.

SUMMARY OF THE INVENTION

The touring ski boot heel binding of the invention comprises, in its broadest aspect, a frame adapted to be secured to the upper surface of a touring ski, a rotatable heel latch pivotally mounted on the frame for rotation forwardly to its forwardmost position at which position it is adapted to engage the heel of a touring ski boot and also for rotation rearwardly to its rearwardmost position at which position it is out of engagement with the heel of the ski boot, and latch engagement and disengagement means for maintaining the heel latch in engagement with the heel of the ski boot when the heel latch is at its forwardmost position and for maintaining the heel latch out of engagement with the heel of the boot when the heel latch is at its rearwardmost position. The latch engagement and disengagement means has an operating lever pivotally mounted on the frame rearwardly of the rotatable heel latch for rotating or permitting rotation of the heel latch of its forwardmost position, and it also has a spring loaded piston mounted for longitudinal movement on the frame rearwardly of the heel latch for rotating the heel latch to its rearwardmost position.

The operating lever is rotatable from a generally horizontal position to an angled with respect to horizontal position and return. In one embodiment of the invention the operating lever is directly connected to the heel latch by means of a connecting link so that rotation of the operating lever to its horizontal position rotates the heel latch to its forwardmost position and maintains the heel latch in this positon and so that rotation of the operating lever to its angled position rotates the heel latch to its rearwardmost position at which position it is maintained by the spring loaded piston. In another embodiment of the invention the heel latch is releasably maintained at its forwardmost position and at its rearwardmost position by the spring loaded piston which is connected to the heel latch by an eccentric over-center linkage, the operating lever rotating the heel latch from its rearwardmost position to its forwardmost position when the operating lever is rotated from its horizontal position to its angled position. In yet another embodiment of the invention the heel latch is releasably maintained at its forwardmost postion and at its rearwardmost position by the spring loaded piston which is again connected to the heel latch by an eccentric over-center linkage. The operating lever is connected to a spring compressor member so that the spring of the spring loaded piston will press firmly against the piston when the operating lever is at its horizontal position and so that the spring pressure on the piston is released when the operating lever it at its angles position. Release of the spring pressure on the piston permits the heel latch to be rotated freely from its rearwardmost to its forwardmost position and return.

The operating lever acts either directly or indirectly to rotate or permit rotation of the heel latch. The heel latch may be positively held at its forwardmost position by the operating lever, or it may be releasably held at its forwardmost position by the spring loaded plunger and associated eccentric overcenter linkage. In the latter case, the ski boot heel binding incorporates a safety release feature. Other features and advantages of ski boot heel binding of the invention will be apparent from the following description thereof.

BRIEF DESCRIPTION OF THE DRAWINGS

The touring ski boot heel binding of the invention will be better understood from the following detailed description thereof in conjunction with the accompanying drawings of which.

DETAILED DESCRIPTION

Figure 1:
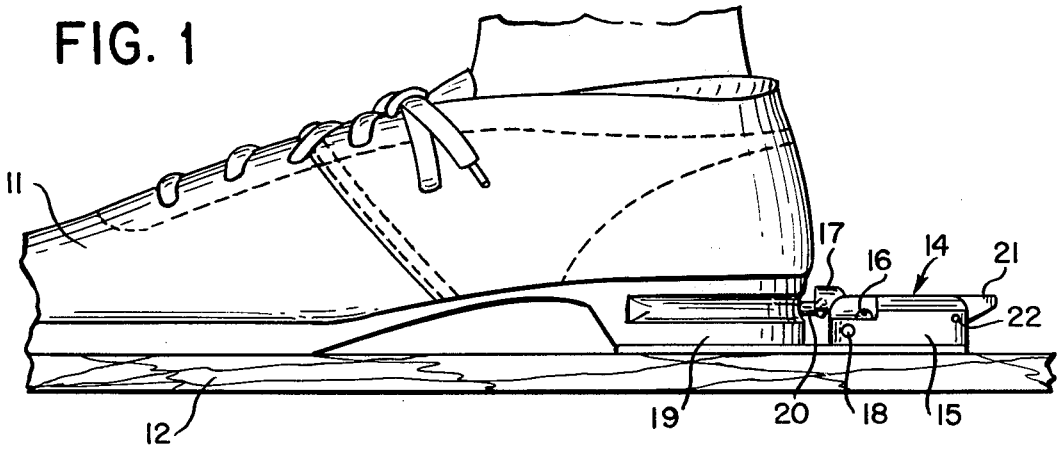
FIG. 1 is a fragmentary side elevation of a touring ski and touring ski boot together with an advantageous embodiment of the heel binding of the invention in its boot engaging position.

As previously mentioned, touring skis are long, narrow and of very light construction usually either of laminated wood or fiber glass. Touring ski boots are light weight and low cut with a very flexiblle sole to allow the boot heel to be raised freely while walking or gliding on the skis. Touring ski bindings normally attach only the toe of the ski boot to the ski to allow for walking and gliding movements on the part of the skier. The skis and ski boots shown in the drawings are of the touring type. Specifically, as shown best in FIGS. 1 to 3 the touring ski boot 11 is secured to the touring ski 12 by a conventional touring ski toe binding (not shown) of the type well known in the art. The heel of the ski boot 11 is releasably secured to the ski 12 by the ski boot heel binding 14 of the invention.

In the embodiment of the heel binding of the invention shown in FIGS. 1 to 6 the heel binding comprises a frame 15 secured to the ski 12 by the screws 16. A rotatable heel latch 17 is pivotally mounted on the frame by means of the transverse pivot pin 18. The heel latch is rotatable forwardly to its forwardmost position at which positon it is adapted to engage the heel of the touring ski boot 11 as shown best in FIGS. 1 and 5, and it is rotatable rearwardly to its rearwardmost position at which position it is out of engagement with the heel of the ski boot as shown best in FIGS. 2 and 6. Heel latch engagement and disengagement means are provided for maintaining the heel latch 17 in engagement with the heel of the ski boot when the heel latch is at its forwardmost position and for maintaining the heel latch 17 out of engagement with the heel of the ski boot when the heel latch is at its rearwardmost position. The heel 19 of the ski boot 11 is advantageously provided with a heel latch lug 20 which extends rearwardly of the heel in position to be engaged by the heel latch 17 when the heel latch is at its forwardmost position.

Figure 2:
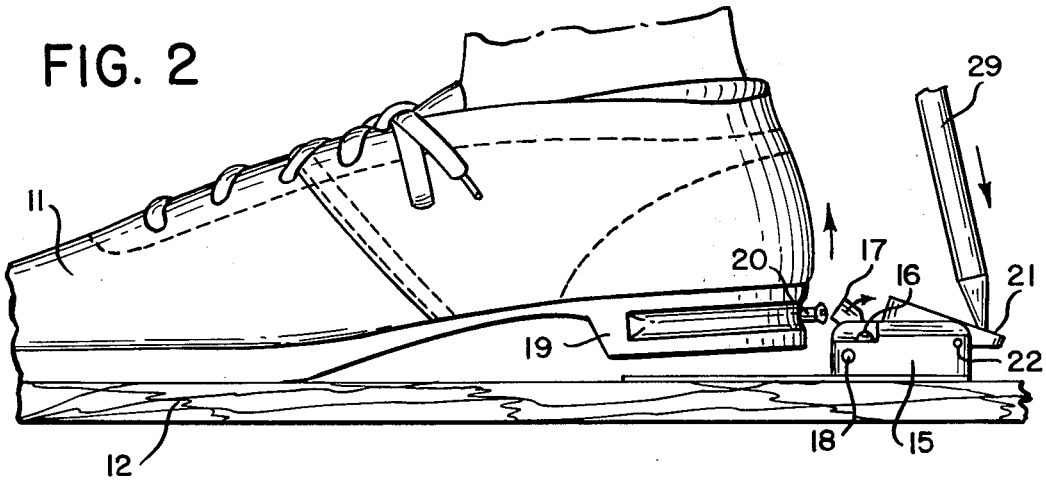
FIG. 2 is a side elevation similar to FIG. 1 showing the heel binding being disengaged.
Figure 3:
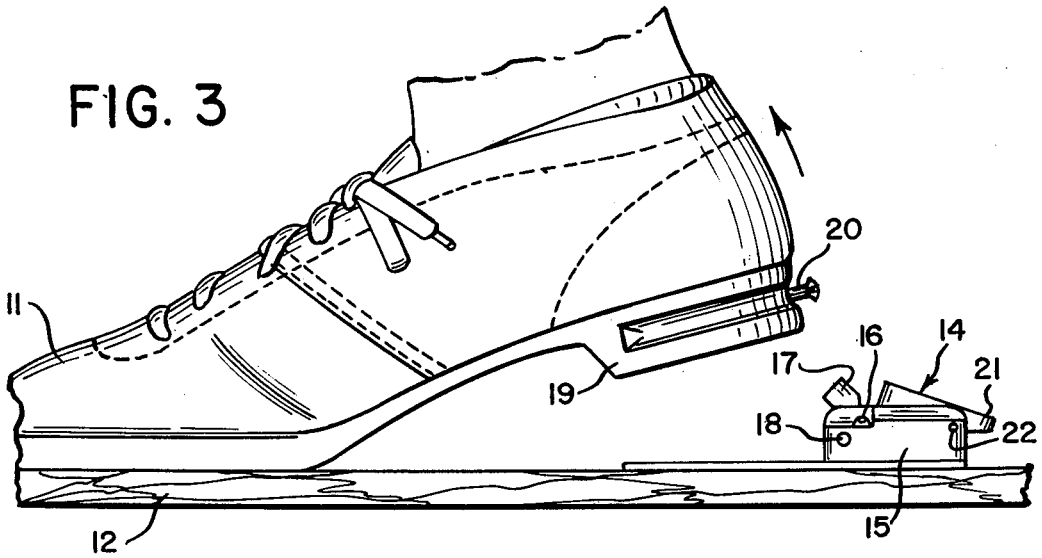
FIG. 3 is a side elevation similar to FIG. 2 showing the heel binding in its disengaged position.

The latch engagement and disengagement means comprises an operating lever 21 pivotally mounted on the frame 15 by means of the transverse pivot pin 22 located rearwardly with respect to the heel latch 17, the operating lever being rotatable to a generally horizontal heel latch locking position as shown in FIG. 1 and to an angles with respect to horizontal heel latch disengagement position position as shown in FIGS. 2 and 3. As shown best in FIGS. 4 to 6, a connecting link 23 is pivotally connected at its forward end to the heel latch 17 above the axis of rotation (that is, above the pivot pin 18) of the heel latch, and the connecting link 23 is pivotally connected at its rearward end to the operating lever 21 forwardly of the axis of rotation (that is, forwardly of the pivot pin 22) of the operating lever. A spring loaded piston 25 is mounted for longitudinal movement on the frame 15 rearwardly with respect to the heel latch 17, the piston 25 pivotally engaging the heel latch 17 at a pivot point 27 that is below the axis of rotation of the heel latch.

Figure 4:
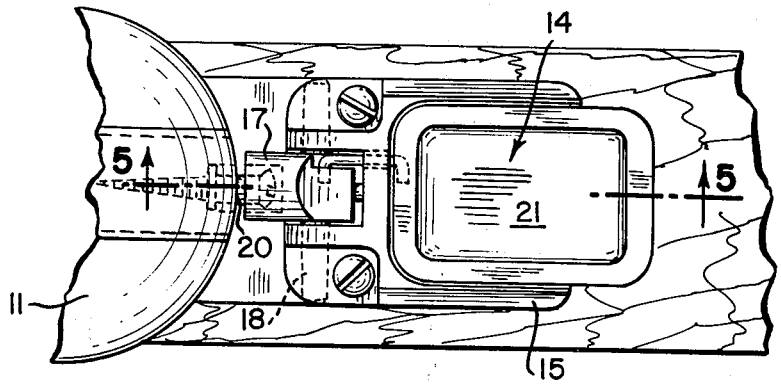
FIG. 4 is a plan view of the heel binding of FIG. 1.
Figure 5:
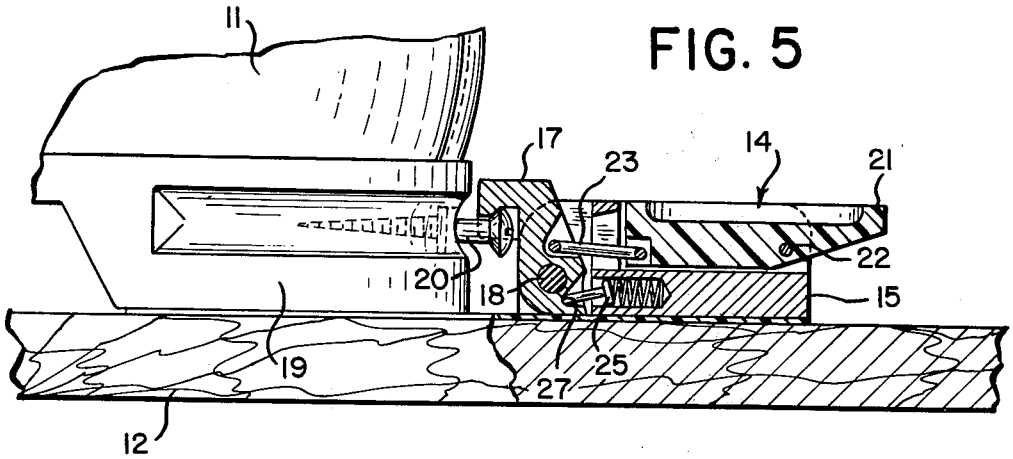
FIG. 5 is a sectional view along lines 5—5 of FIG. 4.
Figure 6:
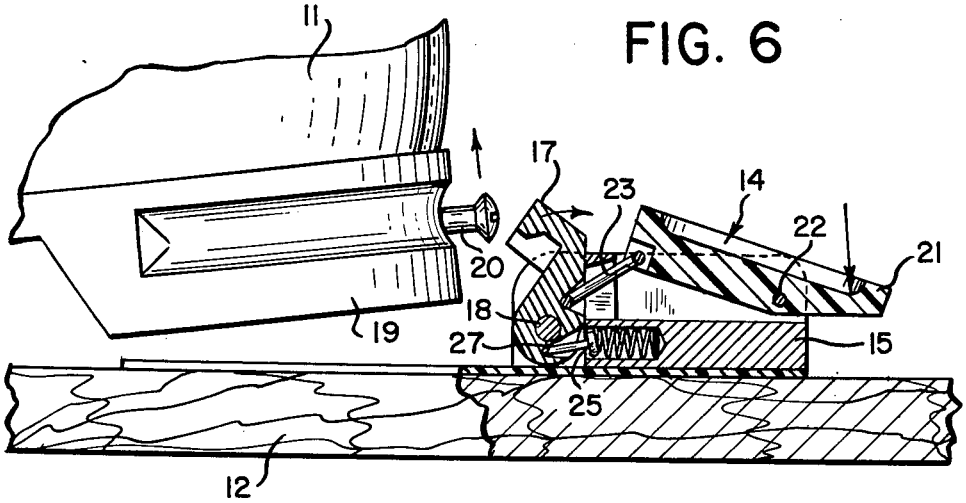
FIG. 6 is a sectional view similar to FIG. 5 and corresponding to FIG. 2.

When the operating lever 21 is rotated to its horizontal position as shown in FIGS. 1, 4 and 5, the heel latch 17 is rotated to its forwardmost boot heel engagement position as also shown in FIGS. 1, 4 and 5. The connecting link 23 is advantageously pivotally connected to the operating lever 21 at a point on the operating lever that is disposed below the axis of rotation of the operating lever when the operating lever is at its horizontal position. As a result, the heel latch 17 is firmly held or "locked" at its boot heel engagement position by the connecting link 23 and operating lever 21, upward pressure of the heel latch lug 20 against the heel latch 17 being resisted by the heel latch which is unable to rotate rearwardly when the operating lever is at its horizontal position. When the operating lever 21 is rotated to its angled position as shown in FIGS. 2, 3 and 6, the heel latch 17 is rotated to its rearwardmost boot heel disengagement position as also shown in FIGS. 2, 3 and 6. The spring loaded piston 25 urges the heel latch 17 toward its rearwardmost position, and the piston 25 tends to maintain the heel latch at this position.

When the heel latch 17 is at its boot heel engagement position as shown in FIGS. 1, 4 and 5, the heel 19 of the ski boot 11 is firmly held against the ski 12, thereby permitting firm control of the ski when skiing downhill. When the heel latch 17 is at its boot heel disengagement position as shown in FIGS. 2, 3 and 6, the heel of the ski boot is free to lift from the surface of the ski thereby facilitating walking and gliding on relatively level surfaces. Moreover, the heel latch 17 can readily be moved from its boot heel engagement position to its boot heel disengagement position by pressing on the rearward end of the operating lever 21 with a ski pole 29 as shown in FIG. 2, and it can readily be returned to its ski boot engagement position by pressing on the forward end of operating lever with the ski pole.

Figure 7:
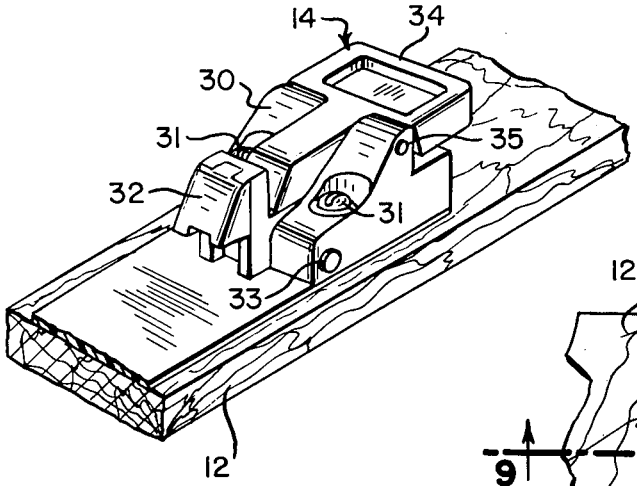
FIG. 7 is a perspective view of another advantageous embodiment of the heel binding of the invention.
Figure 8:
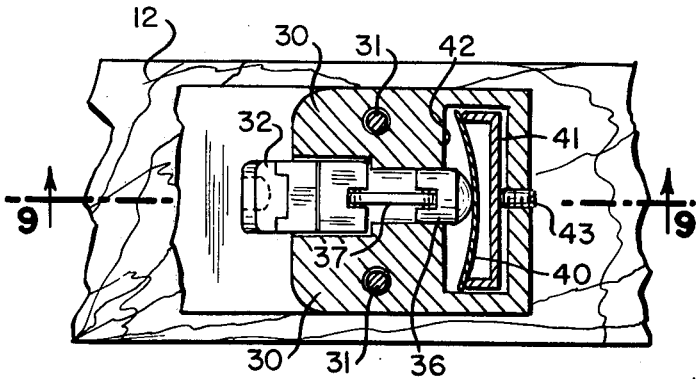
FIG. 8 is a sectional view along a horizontal plane extending through the frame of the heel binding of FIG. 7.
Figure 9:
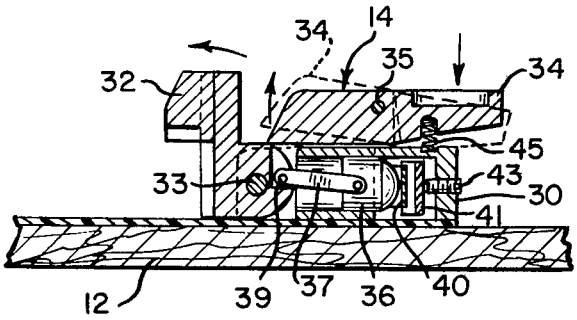
FIG. 9 is a sectional view along lines 9—9 of FIG. 8 showing the heel binding in its boot engagement position.
Figure 10:
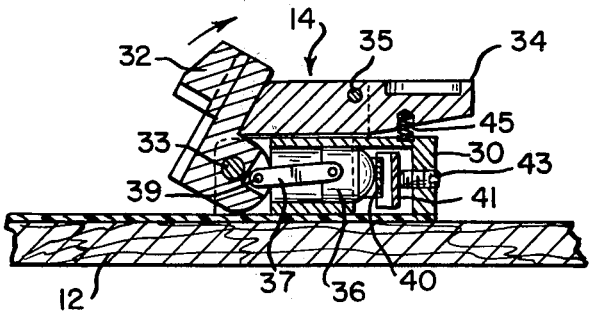
FIG. 10 is a sectional view similar to FIG. 9 showing the heel binding in its boot heel disengagement position.

In the embodiment of the heel binding shown in FIGS. 7 to 10 of the drawings, the binding 14 comprises a frame 30 secured to the ski 12 by the screws 31. A rotatable heel latch 32 is pivotally mounted on the frame 30 by means of the transverse pivot pin 33. As before, the heel latch 32 is rotatable forwardly to its boot heel engagement position as shown in FIGS. 7 and 9 and is rotatable rearwardly to its boot heel disengagement position as shown in FIG. 10. The heel latch engagement and disengagement means includes an operating lever 34 that is pivotally secured to the frame 30 by means of the transverse pivot pin 35 located rearwardly with respect to the heel latch 32, the operating lever 34 being rotatable from a generally horizontal position as shown in FIG. 7 to an angled with respect to horizontal position as shown in outline in FIG. 9.

A spring loaded piston 36 is mounted for longtiudinal movement of the frame 30 rearwardly of the heel latch 32, the longitudinal axis of the piston 36 being generally perpendicular to the axis of rotation (the pivot pin 33) of the heel latch 32. A connecting rod 37 is pivotally connected at its rearward end to the piston 36 and is pivotally connected at its forwrd end to the heel latch 32 at a pivot point 39 thereon eccentric with respect to the axis of rotation of the heel latch. The spring 40 of the spring loaded piston 36 presses the piston and the connecting rod 37 firmly against the heel latch 32 so that when the eccentric pivot point 39 is positioned above the pivot pin 33 as shown in FIG. 9 the heel latch 32 is releasably held at its forwardmost boot heel engagement position by the spring loaded piston 35 as also shown in FIG. 9, and when the eccentric pivot point 39 is positioned below the pivot pin 33 as shown in FIG. 10 the heel latch 32 is releasably held at its rearwardmost boot heel disengagement position by the spring loaded piston 36 as also shown in FIG. 10.

As shown best in FIG. 8, the spring 40 is a flat or leaf spring the center of which presses against the rearward end of the piston 36 and the ends of which are pressed by the forwardly extending ends of the spring compressor member 41. The spring compressor member 41 is mounted for longitudinal movement in the recess 42 formed in the frame 30, and in the embodiment shown it comprises a C-shaped member the forwardly extending ends of which press against the ends of the spring 40 as previously noted. The pressure of the spring 40 against the piston 36 may be adjusted by means of the adjustment screw 43 which, when rotated, moves the spring compressor member 41 either forwardly or rearwardly as desired. Other types of springs such, for example, as a compression coil spring may be used in place of the leaf spring shown in FIG. 8. As shown best in FIGS. 9 and 10, a spring means 45 mounted on the frame 30 urges the operating lever 34 to its horizontal position.

When the heel latch 32 is at its forwardmost boot engagement position as shown in FIGS. 7 and 9, the heel latch 32 is maintained at this position by the spring loaded plunger 36 and can only be rotated to its rearwardmost boot heel disengagment position by overcoming the pressure exerted by the spring 40 against the piston 36. This can be accomplished by manually pressing the heel latch 32 rearwardly by hand or by means of a ski pole. In addition, the heel latch 32 can be rotated rearwardly by upward pressure exerted thereon by the heel latch lug 20 on the heel of a ski boot. This upward pressure can either be applied deliberately by the skier when he wishes to release the heel of his ski boot or it can be applied automatically by the heel latch lug 20 in the event of an accidental fall by the skier. In the latter case the automatic rearward rotation of the heel latch 32 serves as a safety release feature in the event of an accidental fall. As noted, the force required to overcome the pressure of the spring 40 may be increased or decreased by appropriate adjustment of the spring compressor member 41 and adjustment screw 43.

When the heel latch 32 is at its rearwardmost boot heel disengagement position as shown in FIG. 10, the rearward surface of the heel latch rests against the forward facing surface of the operating lever 34, and the heel latch 32 is releasably held at this position by the spring loaded piston 36. When at this position the heel of the ski boot may be freely lifted from the surface of the ski as required when walking or gliding on the ski. The heel latch 32 is returned to its forwardmost boot heel engagement position by pressing dowsn on the rearward end of the operating lever 34. This causes the forward end of the operating lever 34 to rise and thereby press or cam the heel latch 32 to its foward position as indicated in FIG. 9 of the drawings.

Figure 11:
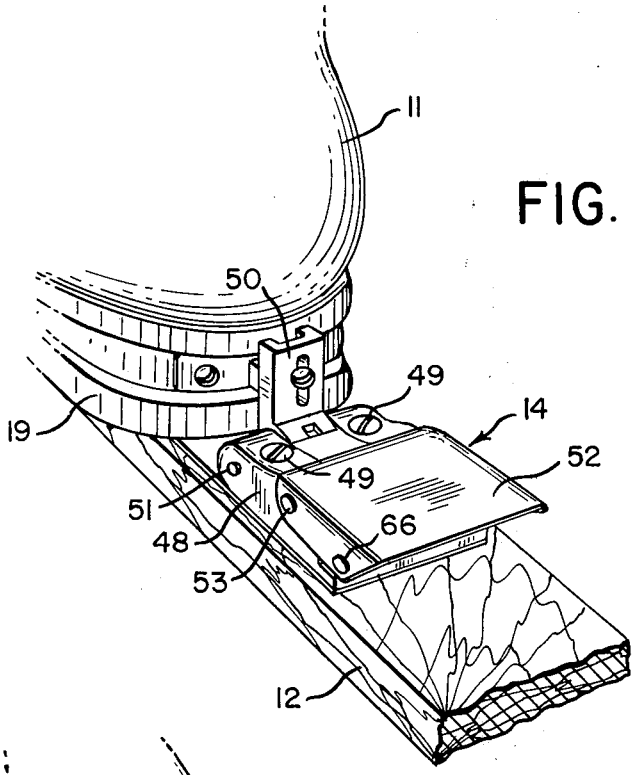
FIG. 11 is a perspective view of yet another advantageous embodiment of the heel binding of the invention.
Figure 12:
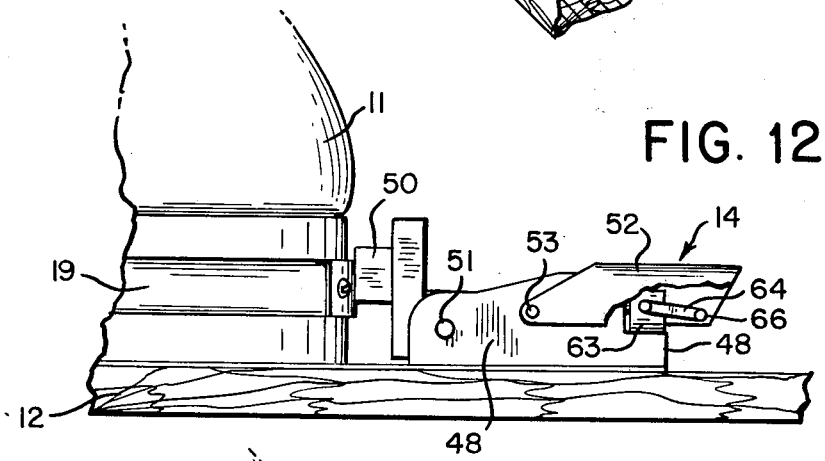
FIG. 12 is a side elevation of the heel binding of FIG. 11 showing the heel binding in its boot heel engagement position.
Figure 13:
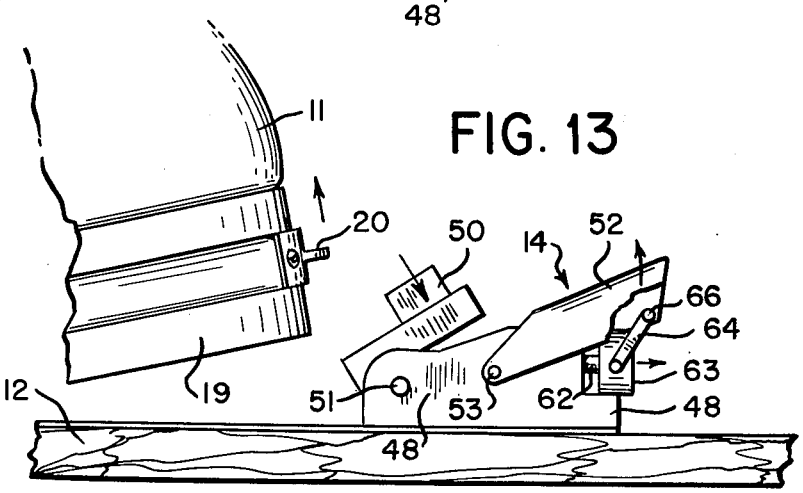
FIG. 13 is a side elevation similar to FIG. 12 showing the heel binding in its boot heel disengagement position.
Figure 14:
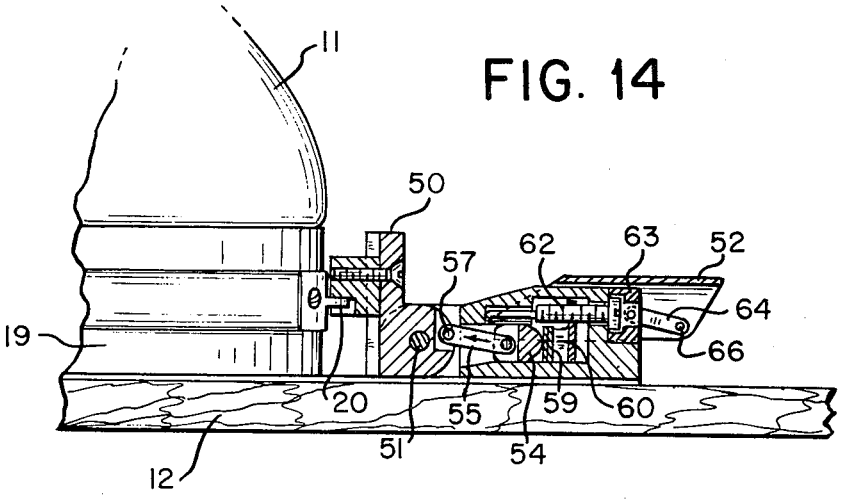
FIG. 14 is a sectional view along a vertical plane coinciding with the longitudinal center line of the heel binding of FIG. 12.
Figure 15:
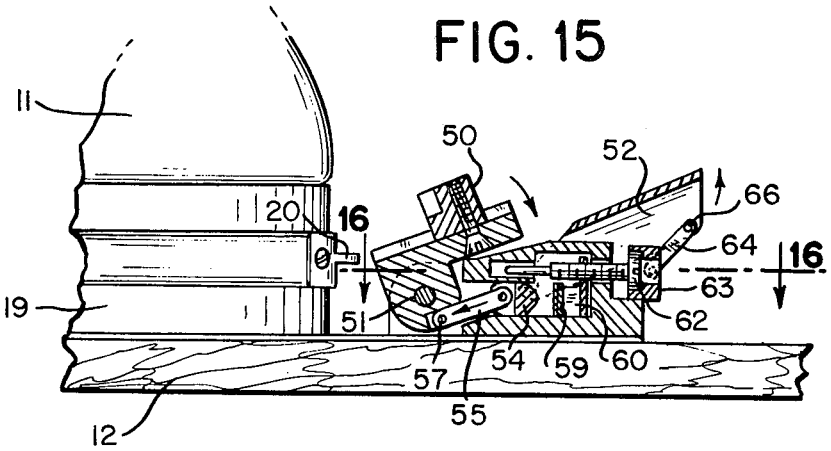
FIG. 15 is a sectional view similar to FIG. 14 and corresponding to the heel binding as shown in FIG. 13.
Figure 16:
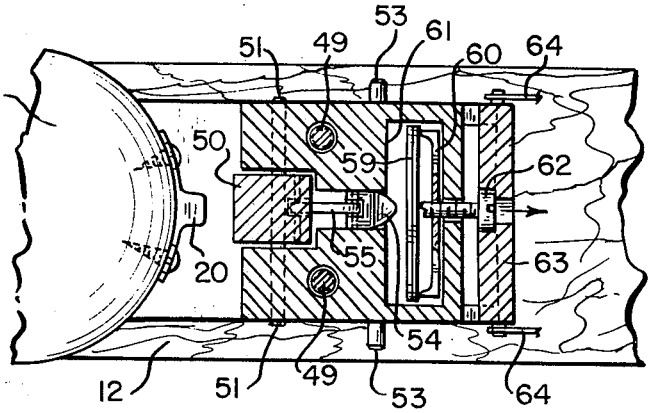
FIG. 16 is a sectional view along lines 16—16 of FIG. 15.

In the embodiment of the heel binding shown in FIGS. 11 to 16 of the drawings, the binding 14 comprises a frame 48 secured to the ski 12 by the screws 49. A rotatable heel latch 50 is pivotally mounted on the frame 48 by means of the transverse pivot pin 51. As before, the heel latch is rotatable forwardly to its boot heel engagement position as shown in FIGS. 11, 12 and 14 and is rotatable rearwardly to its boot heel disengagement position as shown in FIGS. 13, 15 and 16. The heel latch engagement and disengagement means includes an operating lever 52 that is pivotally secured to the frame 48 by means of the transverse pivot pin 53 located rearwardly with respect to the heel latch 50, the operating lever 52 being rotatable from a generally horizontal position as shown in FIGS. 12 and 14 to an angled with respect to horizontal position as shown in FIGS. 13 and 15.

A spring loaded piston 54 is mounted for longitudinal movement on the frame 48 rearwardly of the heel latch 50, the longitudinal axis of the piston 54 being generally perpendicular to the axis of rotation (the pivot pin 51) of the heel latch 50. A connecting rod 55 is pivotally connected at its rearward end to the piston 54 and is pivotally connected at its forward end to the heel latch 50 at a pivot point 57 thereon eccentric with respect to the axis of rotation of the heel latch.

The spring 59 of the spring loaded piston 54 presses the piston and the connecting rod 55 firmly against the heel latch 50 so that when the eccentric pivot point 57 is positioned above the pivot pin 51 as shown in FIG. 14 the heel latch 50 is releasably held at its forwardmost boot heel engagement position by the spring loaded piston 54 as also shown in FIG. 14, and when the eccentric pivot point 57 is positioned below the pivot pin 51 as shown in FIG. 15 the heel latch 50 is releasably held at its rearwardmost boot heel disengagement position by the spring loaded piston 54 as also shown in FIG. 15.

As shown best in FIG. 16 the spring 59 is a flat or leaf spring the center of which is adapted to press against the rearward end of the piston 54 (shown best in FIG. 14) and the ends of which are pressed by the forwarding extending ends of the spring compressor member 60. The spring compressor member 60 is mounted for longitudinal movement in the recess 61 formed in the frame 48, and in the embodiment shown it comprises a C-shaped member the forwardly extending ends of which press against the ends of the spring 59 as previously noted. The pressure of the spring 59 against the piston 54 may be adjusted by means of the adjustment screw 62 which, when rotated, moves the spring compressor member 60 either forwardly or rearwardly as desired. Other types of springs such, for example, as a compression coil spring may be used in place of the leaf spring shown in FIG. 16.

The rearward end of the adjustment screw 62 may be secured to the frame 48 as it is in the embodiment shown in FIG. 8, in which case the spring loaded piston 54 and the associated eccentric over-center linkage with the heel latch 50 will function as described in connection with the embodiment shown in FIG. 8. In the embodiment shown in FIGS. 11 to 16, the rearward end of the adjustment screw 62 is connected to the operating lever 52 by a spring compressor operating linkage that is adapted to apply spring pressure against the piston 54 or to release this spring pressure by appropriate manipulation of the operating lever.

The spring compressor operating linkage comprises a compressor transfer member 63 that is mounted for longitudinal movement on the frame rearwardly of the spring compressor member 60, the spring compression transfer member 63 being connected to the spring compressor member 60 by means of the aofrmentioned adjustment screw 62 and being connected to the operating lever 52 by a pair of lever connecting links 64.

The lever connecting links 64 are pivotally connected to the ends of the compression transfer member 63 and are also pivotally connected to the operating lever 52 at a point 66 thereon disposed rearwardly of the pivot axis (pivot pin 63) of the operating lever 52. Rotation of the operating lever to its horizontal position moves the compression transfer member 63 to its forwardmost position as shown in FIGS. 12 and 14, and rotation of the operating lever 52 to its angled position moves the compression transfer member to its rearwardmost position as shown in FIGS. 13 and 15. When the compression transfer member 63 is at its forwardmost position the spring 59 is caused to pres firmly against the piston 54 as shown in FIG. 14, and in this case the heel latch 50 can only be rotated from its forwardmost to its rearwardmost position and return by overcoming the pressure exerted thereon by the spring loaded piston 54 and its associated eccentric over-center linkage (the connecting rod 55).

When the compressor transfer member 63 is at its rearwardmost position as shown in FIGS. 15 and 16 the pressure of the spring 59 on the piston 54 is completely released, and in this case the heel latch 50 may be freely rotated without spring resistance from its forwardmost to its rearwardmost position and return.

When the heel latch 50 is at its forwardmost position and the operating lever 52 is at its horizontal position as shown in FIGS. 11, 12 and 14, the heel latch 50 is maintained at this position by the spring loaded plunger 54 and can only be rotated to its rearwardmost position by overcoming the pressure exerted by the spring 59 against the piston 54. This can be accomplished by manually pressing the heel latch 50 rearwardly by hand or by means of a ski pole. In addition, the heel latch 50 can be rotated rearwardly by upward pressure exerted thereon by the heel latch lug 20 on the heel of a ski boot. This upward pressure can be applied deliberately by the skier when he wishes to release the heel of his ski boot or it can be applied automatically in the event of an accidental fall by the skier. As noted, the force required to overcome the pressure of the spring 59 may be increased or decreased by an appropriate movement of the spring compressor member 60 and the adjustment screw 62. Alternatively, the heel latch 50 can be easily rotated to its rearwardmost position simply by moving the operating lever 52 to its angled position to release the spring pressure on the piston 54 as previously described.

When the heel latch 50 is at its rearwardmost position as shown in FIGS. 13, 15 and 16, the heel of the ski boot may be freely lifted from the surface of the ski as required when walking or gliding on the skis. When the operating lever 52 is moved to its horizontal position to apply spring pressure on the piston 54, the heel latch 50 is releasably held at its rearwardmost position by the spring loaded piston 54. The heel latch 50 is returned to its forwardmost position either by manually rotating the heel latch forwardly against the pressure of the spring loaded piston or, preferably, the operating lever 52 can be moved to its angled position to release the spring pressure on the piston 54 and to allow the heel latch to be rotated forwardly without spring resistance. Then, when the heel latch 50 is at its forwardmost boot heel engagement position, the operating lever is returned to its horizontal position to re-apply spring pressure to the piston 54.

We claim:

1. A touring ski boot heel binding adapted to be mounted on the upper surface of a touring ski and to releasably engage the heel of a touring ski boot which comprises:

a frame adapted to be secured to the upper surface of a touring ski;

a rotatable heel latch pivotally mounted on the frame, said heel latch being rotatable forwardly to its forwardmost position at which position it is adapted to engage the heel of a touring ski boot and being rotatable rearwardly to its rearwardmost position at which position it is out of engagement with the heel of said ski boot; and latch engagement and disengagement means for maintaining the heel latch in engagement with the heel of the ski boot when the heel latch is at its forwardmost position and for maintaining the heel latch out of engagement with the heel of the ski boot when the heel latch is at its rearwardmost position, said latch engagement and disengagement means comprising a spring loaded piston mounted for longitudinal movement on the frame rearwardly of the heel latch with the longitudinal axis of the spring loaded piston disposed generally perpendicular to the axis of rotation of the heel latch, and a connecting rod pivotally connected to the spring loaded piston and also pivotally connected to the heel latch at a pivot point thereon eccentric with respect to the axis of rotation of the heel latch; the spring loaded piston urging the rotatable heel latch to its forwardmost position when the eccentric pivot connection of the connecting rod therewith is above the axis of rotation of the heel latch and urging the heel latch to its rearwardmost position when the eccentric pivot connection of the connecting rod therewith is below the axis of rotation of the heel latch.

2. The touring ski binding according to claim 1 in which the spring loaded piston is provided with adjustable spring means for adjusting the spring pressure exerted by the piston.

3. The touring ski binding according to claim 1 in which an operating lever is pivotally mounted on the frame rearwardly of the rotatable heel latch and is rotatable from a generally horizontal position to an angled with respect to a horizontal position and return, and in which the rotatable heel latch rests against the forward end of the operating lever when the heel latch is at its rearwardmost position and the operating lever is at its horizontal position, rotation of the operating lever from its horizontal position to its angled position causing the rotatable heel latch to rotate to its forwardmost position when in contact with the operating lever.

4. The touring ski binding according to claim 3 in which spring means mounted on the frame urge the operating lever to its horizontal position.

5. The touring ski binding according to claim 1 in which an operating lever is pivotally mounted on the frame rearwardly of the rotatable heel latch and is rotatable from a generally horizontal position to an angled with respect to horizonal position and return, in which a spring compressor member is mounted for longitudinal movement on the frame in contact with the rearward end of the spring, and in which a spring compressor operating linkage is pivotally connected to the operating lever rearwardly of the pivot axis of the operating lever and also to the spring compressor member; the spring loaded piston urging the rotatable heel latch to its forwardmost position when the eccentric pivot point connection of the connecting rod therewith is above the axis of rotation of the heel latch and urging the heel latch to its rearwardmost position when the eccentric pivot point connection of the connecting rod therewith is below the axis of rotation of the heel latch, rotation of the operating lever to its generally horizontal position moving the spring compressor member forwardly and causing the spring to press firmly against the piston, and rotation of the operating lever to its angled position moving the spring compressor member rearwardly to release the pressure of the spring on the piston.

6. The touring ski binding acording to claim 5 in which spring pressure adjustment means are provided for adjusting the pressure of the spring against the piston.

7. The touring ski binding according to claim 5 in which the spring compressor operating linkage comprises a compression transfer member mounted for longitudinal movement on the frame rearwardly of the spring compressor member, a spring adjustment screw connecting the compression transfer member to the spring compressor member, and a lever connecting link pivotally connected to the operating lever rearwardly of the pivot axis of the operating lever and also pivotally connected to the compression transfer member.

* * * * *